US005723168A

United States Patent [19]

Swain et al.

[11] Patent Number: 5,723,168

[45] Date of Patent: Mar. 3, 1998

[54] SOLVENTLESS COATING METHOD EMPLOYING ARAMID FIBERS

[75] Inventors: Eugene A. Swain; Henry T. Mastalski, both of Webster, N.Y.

[73] Assignee: Xerox Corporation, Stamford, Conn.

[21] Appl. No.: 781,300

[22] Filed: Jan. 13, 1997

[51] Int. Cl.[6] ..... B05D 1/28

[52] U.S. Cl. ..... 427/11; 118/76

[58] Field of Search ..... 427/11; 118/76, 118/77

[56] References Cited

U.S. PATENT DOCUMENTS

| | | | |
|---|---|---|---|
| 4,741,918 | 5/1988 | de Nagybaczon et al. | 427/11 |
| 4,869,921 | 9/1989 | Gabel et al. | 427/11 |
| 5,302,485 | 4/1994 | Swain | 430/127 |
| 5,368,890 | 11/1994 | de Nagybaczon | 427/249 |
| 5,650,193 | 7/1997 | Swain et al. | 427/11 |
| 5,683,742 | 11/1997 | Herbert et al. | 427/11 |

FOREIGN PATENT DOCUMENTS

| | | | |
|---|---|---|---|
| 2 114 375 | 10/1972 | Germany | 427/11 |

*Primary Examiner*—Katherine A. Bareford
*Attorney, Agent, or Firm*—Zosan S. Soong

[57] ABSTRACT

A method is disclosed including rubbing an edge region of an applicator across a surface of a substrate at a sufficient pressure and at a sufficient speed relative to the substrate surface, wherein the edge region of the applicator comprises an aramid material, to deposit a portion of the aramid material from the applicator to the substrate in an adherent coating on the substrate surface, wherein the method is accomplished in the absence of a solvent.

10 Claims, 1 Drawing Sheet

SOLVENTLESS COATING METHOD EMPLOYING ARAMID FIBERS

BACKGROUND OF THE INVENTION

This invention relates to a method for depositing thin films of coating material onto a substrate in the absence of a solvent.

The use of solvents for the coating of organic films has long been an industry standard. Recently, such use has come under pressure due to environmental concerns. Additionally, certain polymeric materials cannot be coated from solvent solutions due to insolubility or other factors. For example, the conventional belief appears to be that KEVLAR™, an aramid material available from Du Pont de Nemours, E. I., Co., cannot be coated on a substrate in any manner. Thus there is a need, which the present invention addresses, for a solventless coating method which can deposit thin films of an aramid material onto a substrate.

The following patent documents may be relevant:

Erno Nagy de Nagybaczon et al., U.S. Pat. No. 4,741,918, the disclosure of which is hereby totally incorporated by reference;

William G. Herbert et al., U.S. appln. Ser. No. 08/444,801, filed May 19, 1995 (Attorney Docket No. D/92394) now abandoned;

Erno Nagy de Nagybaczon, U.S. Pat. No. 5,368,890; and

Eugene A. Swain, U.S. Pat. No. 5,302,485.

SUMMARY OF THE INVENTION

The present invention is accomplished in embodiments by providing a coating method comprising rubbing an edge region of an applicator across a surface of a substrate at a sufficient pressure and at a sufficient speed relative to the substrate surface, wherein the edge region of the applicator comprises an aramid material, to deposit a portion of the aramid material from the applicator to the substrate in an adherent coating on the substrate surface, wherein the method is accomplished in the absence of a solvent.

BRIEF DESCRIPTION OF THE DRAWINGS

Other aspects of the present invention will become apparent as the following description proceeds and upon reference to the Figures which represent preferred embodiments.

Unless otherwise noted, the same reference numeral in different Figures refers to the same or similar feature.

DETAILED DESCRIPTION

The phrase "rubbing an edge region of an applicator across a surface of a substrate at a sufficient pressure and at a sufficient speed relative to the substrate surface" indicates that either the applicator, the substrate, or both are moved to create the rubbing action.

Figure 1:
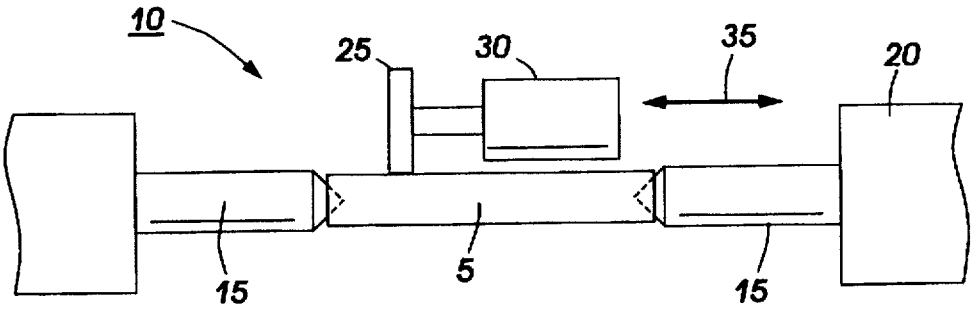
FIG. 1 is a schematic top view of representative equipment that may be used to accomplish the present invention and FIG. 2 is a schematic side view of the applicator being applied against the substrate.

In FIG. 1, substrate 5 is mounted on lathe 10 and is held by holding chucks 15. Motor drive 20 rotates substrate 5. The applicator 25 which may be in the shape of a wheel (the applicator 25 is also referred herein as a "wheel") is mounted on high speed spindle 30 so that the rim of applicator 25 contacts the surface of substrate 5. The rim of the applicator may contact the substrate surface at any effective angle, preferably wherein the plane of the wheel is perpendicular to the substrate surface. Wheel 25 and spindle 30 traverse substrate 5 along direction 35. In embodiments, the bare or coated substrate may be mounted on any suitable device such as a lathe and rotated at an effective speed, preferably about 100 to about 3,000 rpm, and more preferably from about 200 to about 1,000 rpm.

Figure 2:
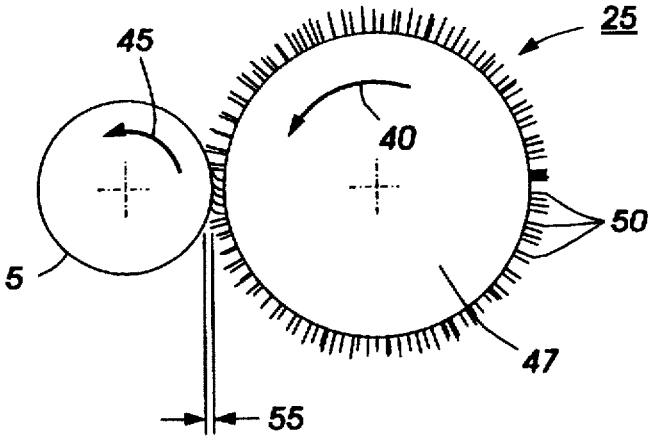

FIG. 2 provides more detail on wheel 25 and substrate 5. The applicator 25 and substrate 5 preferably rotate in counter directions 40, 45 respectively. However, in embodiments, wheel 25 and substrate 5 may rotate in the same direction. The applicator 25 has two distinct areas. Bound region 47 is that portion which contains epoxy adhesive or other means such as stitching or clamping devices which join together the various layers of material that constitute the applicator. Fiber length 50 is that portion which is free of epoxy adhesive or other means that join the various layers of the wheel together. This free fiber length 50 is also referred to as "free material," "free fibers," or "edge region." The free fibers generally face radially outward. As wheel 25 contacts and roughens the surface of substrate 5, the free fibers 50 at the area of contact impact the substrate, wherein the distance that the fiber's length impacts the substrate surface is described as interference 55. The extent of interference 55 may be of any effective length, preferably ranging from about 0.010 to about 0.050 inch, more preferably from about 0.010 to about 0.020 inch, and most preferably about 0.015 inch, where 0.0 inch is defined to be the point where the free fibers are just touching the substrate surface without any bending or compression of the free fibers at the point of contact. The applicator may be of any effective shape and is preferably disc-shaped.

The peripheral surface speed of the applicator is determined by the following formula: surface speed=(rotation speed)×(wheel diameter) ×pi. Rotation speed is measured in revolutions per minute ("rpm"). The surface speed, the rotation speed, and the wheel diameter may be any suitable value for depositing the coating on the substrate surface. In embodiments, the surface speed of the applicator is at least about 1,000 ft/min. The applicator surface speed may be at least about 8,000 ft/min, preferably from about 10,000 to about 60,000 ft/min, more preferably from about 20,000 to about 60,000 ft/min, and most preferably from about 25,000 to about 50,000 ft/min. The applicator may rotate in embodiments at a speed of from about 10,000 to about 400,000 rpm, preferably from about 15,000 to about 100,000 rpm, and more preferably from about 30,000 to about 80,000 rpm. In embodiments, the wheel diameter has a diameter of from about ¾ to about 12 inches, preferably from about 1 to about 8 inches, and more preferably from about 2 to about 6 inches. In embodiments of the present invention, the rotation speed and surface speed of the wheel are sufficiently high to enable the free fibers of the wheel to "flare out." The phenomenon of "flare out" is generally evidenced by a change in noise pitch and a slight drop in rotational speed and is believed to be caused when air currents, generated by the rapidly rotating wheel, fluff the free fibers and cause them to vibrate. "ire out" of the free material of the applicator is desired since it is believed to facilitate at least in part the deposition of the coating on the substrate surface. "Flare out" of the free fibers, however, is not necessary in every instance.

The applicator has several other parameters. In embodiments, the wheel has a free fiber length of from about 1/16 to about 2 inches, and preferably 1/8 to about ½ inch. The applicator has a width of any effective value, preferably from about 1/16 to about 2 inches, more preferably 1/8 to about ½ inch. It is also possible to utilize multiple applicators on multiple spindles which all contact the substrate simultaneously. It is also possible to utilize a wheel which has a width which is equal to the length of the substrate. In this case the wheel need not be traversed along the length of the substrate but simply contacted against the entire length of the rotating substrate for a very short time period. Values outside these specifically recited ranges are encompassed provided the objectives of the present invention are met.

The present invention is not limited to the use of a single wheel. In fact, two or more applicators may be joined together to form a multi-segment wheel. In a multi-segment wheel, the free fibers of the middle wheels may not "flare out" as well or not at all as compared with the wheels on either end. To improve the air flow characteristics thereby facilitating "flare out," one or more or all of the wheels constituting the multi-segment wheel may be slotted and spaced apart. The slots may be of any suitable shape, number and arrangement. Preferably, there are four elliptically shaped slots arranged in a diamond pattern. The slots may be made by conventional machining with an end mill. In certain embodiments, an air scoop made of any suitable material such as metal, plastic, or composite material may be associated with each slot to further improve the air flow characteristics. The air scoop may be of any suitable shape such as a slat or a curved shape, similar to a louver. Of course, slots and slots with air scoops may also be employed in those embodiments employing only a single wheel.

Several embodiments of the applicator permit an increase in the width of the surface that can be rubbed and therefore an increase in traverse speed. In one embodiment, the wobble wheel, there is provided any effective means to enable the wheel to wobble or oscillate as it rotates. It is believed that an oscillating wheel will rub a larger surface width than a rigidly mounted rotating wheel. This may be accomplished, for example, by attaching a wedge shaped washer to each side of the buffing wheel. In a second embodiment, the wavey wheel, there is provided a buffing wheel wherein the rim thereof is contoured into an undulating form. The wavey wheel may be made, for example, by taking the epoxy bonded wheel out of the die early, before the epoxy hardens, so that the wheel is soft and pliable. The wheel is then placed into a die with bias spacers positioned at appropriate intervals which offsets the rim from the plane of the wheel into a number of arc-shaped contours. The epoxy in the wheel is then allowed to harden, yielding the wavey wheel. In a third embodiment, the width of the applicator conforms to the length of the substrate to be conditioned, thereby eliminating the movement necessary with a narrower wheel along the axial direction of the substrate.

The applicator may be prepared by any appropriate method. In one embodiment, round discs of the polymeric material are cut out from the fabric (which is comprised of fibers) from which the wheel is to be made. The fabric discs are layered one on top of each other at a 45 degree orientation from one another (assuming a square weave fabric). The number of layers depends on the thickness desired. The fabric layers are then sewn together using a sewing machine in concentric rings. After sewing is complete, the center of the discs is located and a hole is punched through of an appropriate size for a mounting mandrel. The wheel is mounted on a mandrel and rotated at about 1,000 rpm. The edge of the wheel is trimmed with coarse abrasive paper. Progressively freer abrasive papers are then used to finish conditioning of the wheel In a second embodiment, preparation of the wheel is accomplished similar to the above, except that the fabric layers are pressed together by two circular metal plates instead of being sewn together. In the above embodiments, the free fiber length is that length which extends beyond the stitches or the metal plates. A preferred method for preparing the applicator using epoxy adhesive is illustrated in the Examples. At least the edge region of the applicator comprises the polymeric material, and preferably the entire applicator comprises the polymeric material. In those embodiments where the bound region of the applicator contains an adhesive, the applicator may be discarded after the edge region is worn away during the present method.

The substrate may have a surface hardness on the Brinell Hardness Index of about 600 or below, preferably from about 5 to about 400, and most preferably from about 10 to about 80. The substrate can be formulated entirely of an electrically conductive material or an insulating material, or it can be an insulating material having an electrically conductive surface. The substrate is of an effective thickness, generally up to about 100 mils, and preferably from about 1 to about 50 mils, although the thickness can be outside of this range. The thickness of the substrate layer depends on many factors, including economic and mechanical considerations. Thus, this layer may be of substantial thickness, for example over 100 mils, or of minimal thickness provided that there are no adverse effects on the device. In a preferred embodiment, the thickness of this layer is from about 3 mils to about 40 mils. The substrate can be opaque or substantially transparent and can comprise numerous suitable materials having the desired mechanical properties. The entire substrate can comprise the same material as that in the electrically conductive surface or the electrically conductive surface can merely be a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate can be fabricated from any other conventional material, including organic and inorganic materials. Typical substrate materials include insulating non-conducting materials such as various resins known for this purpose including polycarbonates, polyamides, polyurethanes, paper, glass, plastic, polyesters such as MYLAR® (available from DuPont) or MELINEX 447® (available from ICI Americas, Inc.), and the like. The coated or uncoated substrate can be flexible or rigid, and can have any number of configurations, such as a plate, a cylindrical drum, a scroll, an endless flexible belt, or the like. The surface of the substrate may comprise a metal oxide such as aluminum oxide, nickel oxide, titanium oxide, and the like. The substrate may be of any diameter such as from about 20 mm to about 650 mm.

The applicator can be fabricated from an enormous variety of materials including an organic polymer. Illustrative examples include: polyolefins such as polyethylene, polypropylene, polybutylene and copolymers of the foregoing; halogenated polyolefins such as fluorocarbon polymers like polytetrafluoroethylene and perfluoroalkoxy resin; polyesters such as polyethyleneterephthalate; vinyl polymers such as polyvinylchloride and polyvinyl alcohol; acrylic polymers such as polymethylmethacrylate and polyethylmethacrylate; polyurethanes; and an aramid such as KEV- LAR™ (believed to be poly(p-phenyleneterephthalamide)) and NOMEX™ (believed to be based on poly(m-phenyleneisophthalamide)), both of these aramids being available from the DuPont Company. Suitable aramid materials for the present method are described in *Kirk-Othmer Encyclopedia of Chemical Technology*, Vol. 3, pp. 213–241 (3d ed. 1978), the disclosure of which is totally incorporated herein by reference.

Aramid polymers do not melt, for all practical purposes, other than at temperatures involving decomposition, and they are nearly insoluble. Aramids may be categorized into: (1) heat and flame-resistant aramid materials which generally contain a high portion of meta-oriented phenylene rings; and (2) ultra high-strength-high-modulus aramid materials which contain principally para-oriented phenylene rings. The aramid material may have a melting or decomposition temperature below about 800° F., preferably ranging from about 100 to about 600° F., and more preferably from about 300 to about 500° F. It is believed that KEVLAR™ decomposes at about 800° F. It is preferred that the aramid material of the applicator is in the form of fibers, such as monofilaments, wherein the fibers have a diameter ranging from about 5 to about 10 microns, and especially about 7 to about 8 microns, and the fibers have sufficient tensile strength to withstand the forces imparted by the high speed rotation and subsequent contact with the substrate. Preferably, the entire edge region of the applicator is fabricated solely from the aramid material. If desired, however, mixtures of 2, 3, or more polymeric materials may be used in the applicator such as using different kinds of aramids or using an aramid material in combination with one of the other polymeric materials described herein.

Products which may be made by the invention include magnetic recording media and electrical components having conducting resistive, dielectric or semiconducting layers thereon. Other applications include the formation of protective coatings, decorative coatings, sizing coatings, key coats, light or heat absorbing coatings, light or heat reflective coatings, heat conducting coatings, slip coatings, non-slip coatings, anti-corrosion coatings, anti-static coatings and even abrasive coatings on substances such as metal, paper, glass, ceramics, fabrics and plastics. A preferred use for the invention is for the application of layered material during the fabrication of a photoreceptor.

The coatings can be formed using a wide range of process conditions, which are all dependent on each other. The pressure applied by the wheel, the area of contact between the wheel and the substrate, the peripheral speed of the wheel, and the relative speed between the surface of the wheel and the substrate may all be varied. However, alteration of any one of these parameters may require that one or more of the other parameters be adjusted in order to compensate. In addition, of course, the conditions which are appropriate for forming a coating of a given material on a given substrate may not be appropriate for coating a different substrate. In all cases, however, the appropriate process conditions will be readily determinable by the person skilled in the art.

Generally, the more delicate the substrate, the lower the pressure with which the applicator should be pressed against the substrate, in order to avoid damage thereto. Thus, for example, a very lightweight nonwoven fabric substrate may be coated with plastic materials using for example a 30 cm diameter applicator wheel, by training the fabric round the wheel, and applying only a slight tension (e.g., from 10 to 100 grams/cm width of fabric, depending on the strength of the fabric). With this arrangement, the pressure with which the wheel bears against the fabric is very low indeed, for example from less than 1 g/cm$^2$ to a few grams/cm$^2$.

When relatively sturdy substrates are used, it may be appropriate to use still larger contact pressures between the applicator and the substrate. For example, pressures greater than 1 kg/cm$^2$ may be appropriate for coating metal substrates, including pressures of from about 2 to about 100 kg/cm$^2$ and preferably from about 5 to about 50 k/cm2.

Although the factors which determine the appropriate coating conditions for different substrates are imperfectly understood, it will be apparent that identifying the appropriate conditions for a given substrate is merely a matter of trial and error. The operator need only choose a coating technique which is appropriate to the strength and flexibility of the substrate in question, and then increase the applicator pressure and/or applicator speed until a desired coating is formed.

Typically the coating formed is very thin, but nonetheless adherent, non-granular in appearance and substantially free of micropores. In embodiments of the present invention, the coating is not strongly adhered to the substrate as the coating can be removed by peeling off the substrate. Even in cases when the polymeric material had a very high melting point, the coating may have a characteristic smeared appearance under high magnification scanning electron microscopy, strongly suggesting plastic deformation of the polymeric material at the time of film formation.

The coatings formed by the present method have a number of important characteristics in embodiments of the instant invention. Firstly, they may be very thin, being less than for example about 3 microns in thickness. More usually, they are substantially thinner than this, very often being less than about 500 nm thick and often less than about 200 nm thick. Typical film thicknesses are from about 1 to about 100 nm thick, preferably from about 5 to about 50 nm thick. A most unusual characteristic of the process of the invention is that in embodiments, the coatings produced thereby are effectively self-limiting in thickness, in the sense that the coating, once formed, will generally not increase in thickness even by increasing the time the applicator is rubbed over the surface. Another preferred characteristic of the films formed by the process of the invention is that they may be substantially nonporous. This is highly unusual in such thin coatings. Yet a further characteristic of the coatings formed by the method of the invention is that they are generally substantially free of voids, i.e., continuous. This is in marked contrast to the coatings formed by many prior art techniques, such as sputtering.

While it is possible to employ the present invention in combination with the application of discrete particles of the polymeric material to the substrate in a manner similar to the method disclosed in Erno Nagy de Nagybaczon et al., U.S. Pat. No. 4,741,918, preferably there is absent the step of applying discrete particles of the polymeric material to the substrate surface. The use of discrete particles is disadvantageous since a discrete particle delivery system is then needed and the discrete particles may be incompatible with the applicator.

The present method transfers applicator material to the substrate due to the high relative velocity and angular acceleration between the applicator and the substrate which generate sufficient energies (such as mechanical and thermal energies) at the point of applicator to substrate interface to effect the transfer.

The invention will now be described in detail with respect to specific preferred embodiments thereof, it being understood that these examples are intended to be illustrative only and the invention is not intended to be limited to the materials, conditions, or process parameters recited herein. All percentages and parts are by weight unless otherwise indicated.

EXAMPLE 1

There were provided two circular steel mold plates (base plate and top plate), each having an outside diameter of 6 inches and a through hole of about 1–¼ inches in diameter, for preparing the applicator. The base plate had a concentric projecting rib 4 inches in diameter, wherein the rib was 0.040 inch wide and 0.020 inch high. The projecting rib was to prevent the epoxy from coating the free fibers of the wheel. The base plate was 0.831 inch thick and had 16 small air holes (made by drill plus tap of 10–32 size) arranged at intervals along the inside perimeter of the projecting rib. The top plate was 0.951 inch thick. All components of the mold were cleaned to insure there were no epoxy residue and then sprayed with Teflon mold release spray (Tech Spray 2406-12S dry lube and mold release, available from Tech Spray E.C. Ltd, North Yorkshire, United Kingdom. However, no mold release was sprayed in the area beyond the projecting rib to prevent release spray from coating the free fibers.

A plug with a ⅛ inch hole was inserted in the through hole of the top plate and secured in place with 4 screws. This was where the epoxy adhesive was pumped into the mold. A plug that was filled with epoxy to block off the ⅛ inch hole was inserted into the through hole of the base plate and secured in place with 4 screws.

Sixteen screws that have holes drilled the long way through the center were inserted into the 16 air holes of the base plate. These were vent holes for air evacuation plus indicators showing the epoxy fill progress. Sixteen copper wires of about 3 inches in length were inserted into the screws with the center through holes. The wires were free so that if the mold were tipped upside down, they would fall out of the screws. The wires were to rise or pop-up within the screws as the epoxy begins to follow air out the vent screws.

The base plate was placed on a flat surface with the circular projecting rib facing up. Two ¼ inch dowels were inserted into the holes on the outside diameter of the base plate. These were to align the two plates when placed together. The KEVLAR™ fiber discs were stacked so that each layer was 45 degrees from the previous layer. The KEVLAR™ material was about 0.011 inch thick and accordingly 5 layers were stacked together, yielding stacked layers of 0.055 inch thick. The top plate was placed over the dowels. This captured the KEVLAR™ fibers between the two mold plates.

Four stacks of shims were placed 90 degrees from each other between the mold plates. The thickness of the shim pack was determined by the number of layers and the type of material used in the mold. Accordingly, five layers of KEVLAR™ material required 0.070 inch thickness of shim. Four "C" clamps were placed over the mold and centered over each shim pack. The "C" clamps were tightened evenly around the mold plates. The shim packs kept the two mold plates parallel with each other.

The coupled mold plates were tipped on their side. This allowed access to put the epoxy nozzle tip in the ⅛ inch injection hole in the center of the top plate. This also allowed observation of the copper wire pop-ups for epoxy flow.

The epoxy, Hysol Epoxy Patch® System #EPS 608 (available from Dexter Corp., Seabrook, N.H.) was then injected. Injection was stopped after 75% of the wire pop-ups moved. The proper mold assembly typically resulted in a minimum of 75% wire movement. The intent is to stop injection at the earliest opportunity. Overinjection may result in epoxy migration across the projecting rib. The coupled mold plates were placed down, so that the screws and copper wire pop-ups faced up. The copper wire pop-ups were removed immediately after epoxy injection was stopped. The epoxy was cured for at least 12 to 15 minutes. The 16 screws for the copper wires were backed off about 2 turns to insure that the any epoxy inside the screws were broken off. The two mold plates were then separated, with the fiber wheel adhered to the base plate. The fiber wheel was separated from the base plate by using a small flat blade screw driver. Injection sprue was cut off and slag was trimmed. The center plugs were removed from both mold plates. The ¼ inch drill bushing was inserted in the base plate. The fiber wheel was centered on the base plate using the circular projecting rib and the top plate was placed over the wheel. A hole was then drilled in the center of the fiber wheel and the wheel was removed from between the mold plates. Loose fibers were combed from the wheel. The free fibers of the wheel were trimmed to about 1 inch by cutting off the excess fibers. However, a sufficient length of free fiber material remained so that it can later be dressed.

The fiber wheel was rotated at about 35,000 rpm on a Dumore grinder and the edges groomed by applying a ½ inch putty knife having a glued strip of 80 grit sand paper against the edges of the wheel. The fiber wheel was then rotated at about 42,000 rpm to loosen more fibers and to untangle them. The wheel was groomed again by rotating it at about 35,000 rpm and applying a ½ inch putty knife having the glued strip of sand paper against the edges of the wheel. The above grooming procedures were repeated until there were no loose fibers. The resulting applicator had the following dimensions: about 4-3/16 inches in diameter; about 3/16 inch free fiber length, and about 0.055 inch width.

EXAMPLE 2

A 40 mm diameter aluminum substrate, which was previously diamond turned was loaded on a lathe in a manner so that it can be rotated between centers. The substrate was rotated at 240 rpm in a forward turning direction. The high speed spindle holding the rotating KEVLAR™ fiber wheel (prepared as described in Example 1), rotating at about 42,000 rpm in a direction counter to that of the rotation of the substrate, was positioned so that it was at the left end of the substrate and the buffing wheel was about ¼ inch away from contacting the surface of the substrate. The wheel was moved inward until the first contact was made, indicated by a very slight abrasion on the surface. The inward travel of the wheel was then increased by 0.016 inch and the horizontal traverse was initiated at a speed of 6 inches per minute. The horizontal travel of the wheel was stopped at about ¼ inch from the right end of the substrate. The result of the above procedures was a yellowish-brown continuous coating on the substrate that was determined by Fourier Transform Infrared technique to be KEVLAR™. The coating thickness was estimated to be about 15 microns to about 25 microns.

Other modifications of the present invention may occur to those skilled in the art based upon a reading of the present disclosure and these modifications are intended to be included within the scope of the present invention.

We claim:

1. A coating method comprising rubbing an edge region of an applicator, wherein the edge region of the applicator comprises an aramid material, across a surface of a substrate at a sufficient pressure and at a sufficient speed relative to the substrate surface to deposit a portion of the aramid material from the applicator to the substrate in an adherent coating on the substrate surface, wherein the method is accomplished in the absence of a solvent, wherein there is absent a step of applying discrete coating particles to the substrate surface.

2. The method of claim 1, wherein the rubbing is accomplished by rotating the applicator and rotating the substrate to provide a rubbing contact between the applicator and the substrate and wherein the applicator and the substrate are rotated in opposite directions at the point of rubbing contact.

3. The method of claim 1, wherein the rubbing includes rotating the applicator at a peripheral surface speed of at least about 1,000 ft/min.

4. The method of claim 1, wherein the rubbing includes rotating the applicator at a peripheral surface speed of at least about 8,000 ft/min.

5. The method of claim 1, wherein the rubbing includes rotating the applicator at a peripheral surface speed ranging from about 10,000 to about 60,000 ft/min.

6. The method of claim 1, wherein the rubbing includes rotating the applicator at a speed ranging from about 10,000 to about 400,000 rpm.

7. The method of claim 1, wherein the rubbing includes rotating the applicator at a speed ranging from about 15,000 to about 100,000 rpm.

8. The method of claim 1, wherein the entire edge region of the applicator is fabricated solely from the aramid material.

9. The method of claim 1, wherein the aramid material is poly(p-phenyleneterephthalamide).

10. The method of claim 1, wherein the aramid material is in the form of fibers.

* * * * *